United States Patent [19]

Marushima

[11] 4,071,361

[45] Jan. 31, 1978

[54] ELECTROPHOTOGRAPHIC PROCESS AND APPARATUS

[75] Inventors: Giichi Marushima, Tokyo, Japan

[73] Assignee: Canon Kabushiki Kaisha, Tokyo, Japan

[21] Appl. No.: 563,899

[22] Filed: July 8, 1966

[30] Foreign Application Priority Data

| | | |
|---|---|---|
| Feb. 23, 1966 | Japan | 41-10915 |
| Dec. 1, 1965 | Japan | 40-73379 |
| Oct. 28, 1965 | Japan | 40-65784 |
| Dec. 24, 1965 | Japan | 40-79869 |
| Jan. 9, 1965 | Japan | 40-53471 |
| July 12, 1965 | Japan | 40-41639 |

[51] Int. Cl.[2] ..... G03Q 13/22; G03Q 13/24

[52] U.S. Cl. ..... 96/1.4; 96/1 R; 355/3 R

[58] Field of Search ..... 96/1, 1.5–1.8; 117/17.5; 355/11; 250/49.5

[56] References Cited

U.S. PATENT DOCUMENTS

| | | | |
|---|---|---|---|
| 3,003,869 | 10/1961 | Schaffert | 96/1 |
| 3,041,166 | 6/1962 | Bardeen | 96/1 |
| 3,196,011 | 7/1965 | Gunther et al. | 96/1 |
| 3,234,019 | 2/1966 | Hall | 96/1 |
| 3,307,034 | 2/1967 | Bean | 250/49.5 |
| 3,457,070 | 7/1969 | Watanabe et al. | 96/1 |

*Primary Examiner*—Roland E. Martin, Jr.

*Attorney, Agent, or Firm*—Fitzpatrick, Cella, Harper & Scinto

[57] ABSTRACT

A process for forming an electrostatic image on a plate having a conductive base, a photoconductive layer exhibiting p-type or n-type semiconductivity and a covering insulative layer, said photosensitive plate being characterized in having carrier charge of a polarity corresponding to the conductivity type of said photoconductive layer injectable from said conductive base into said photoconductive layer and bound in the region of the interface between said insulative and photoconductive layers, wherein the covering insulative layer is initially charged with a polarity opposite to the conductivity type of said photoconductive layer to inject and bind charge carrier in the region of the interface between said insulative photoconductive layers, then the photoconductive layer is exposed to a pattern of image light, while a corona discharge of a polarity opposite to the first charge is applied onto the insulative layer, and then the photoconductive layer is exposed to activating light to discharge bound carrier charge remaining in the region of the interface between said insulating and photoconductive layers and form a high contrast electrostatic image.

33 Claims, 10 Drawing Figures

ELECTROPHOTOGRAPHIC PROCESS AND APPARATUS

This invention relates to an electrographic process, and more particularly to the process for forming electrostatic images.

Among conventional electrophotographic porcesses, the Electro Fax system, the Xerox system and the Persistent Internal Polarization (P.I.P.) system are known. In the Electro Fax and Xerox systems, electrostatic images are formed in accordance with the so-called Carlson process disclosed in U.S. Pat. No. 2,297,691, in which the photosensitive plate comprises a photoconductive layer of, for example, zinc oxide (Electro Fax) or amorphous selenium (Xerox) on a base; the photoconductive layer is uniformly charged by corona discharge, and is then irradiated with the original image, to discharge the charge held at the light radiated portion to form on the photoconductive layer an electrostatic image in accordance with the light-and-dark pattern of the original image; the electrostatic image is then developed by an electroscopic powder (hereinafter called a toner) to visualize same; thereafter, in the case of the Electro Fax system, the visualized image is fixed, while in the case of the Xerox system, the visualized image is transferred to a support, such as paper, and then fixed to obtain the electrophotographic image. In the P.I.P. system, the photosensitive plate comprises a conductive base having thereon a mixture of phosphor and resin, and is sandwiched between two electrodes; the voltage is applied between the two electrodes to produce the persistent internal polarizing charge in the photoconductive layer. Then the original image is irradiated to form the electrostatic image by the persistent internal polarizing charge in accordance with light-and-dark pattern of the original image. Thereafter the electrophotographic image is obtained through development and fixing processes.

In the above-mentioned prior art, since it is necessary to bind the charge directly on the photoconductive layer, the substances forming the photoconductive layer have to have high resistivity and be able to bind the charge; these are limited to ZnO + resin, ZnCdS + resin, non-crystallized selenium and the like. For this reason, the sensitivity is low; for example, in the Electro Fax system, the maximum sensitivity is less than ASA5, even if sensitized by the use of dyes, and in the Xerox and P.I.P. systems the maximum sensitivity is ASA10. Furthermore, when the photosensitivity plates are used repeatedly, the surfaces thereof are easily damaged or deteriorated, and the quality of the image deteriorates due to the fatigue of the photoconductive material. These plates thus have a limited life.

U.S. Pat. No. 3,124,456 discloses the use of a photosensitive plate where the photoconductive layer comprising CdS or CdSe and binder resin is adhered to the photoconductive base and a translucent insulating layer is attached onto the photoconductive layer. The original image irradiation and the charge are made simultaneously from the translucent insulating layer side to form an electrostatic image on the insulating layer by utilizing the difference of the charges built up in accordance with the difference of the time constants caused by the difference of the values of the resistances of the photoconductive layer at the light-and-dark portions of the original image. However, to obtain good electrostatic images with this method, the capacitance of the translucent insulating layers must be larger than that of the photoconductive layer, and as a practical matter, the thickness of the translucent insulating layer is limited to the range of from 2–6$\mu$.

As will be explained later in detail, with such a thin insulating layer, break-down of the surface occurs easily and long repetitive use can hardly be expected. Furthermore, in the method described above where the electrostatic image formed depends upon the change of the impedance of the photoconductive layer, when the thickness of the translucent insulating layer is increased, contrast decreases and the quality of the image deteriorates.

U.S. Pat. No. 3,041,167 teaches the use of a photosensitive plate in which the photoconductive layer is protected by an overcoating layer, which is thin in comparison to the photoconductive layer. When the electrostatic image is formed using said photosensitive plate according to the Carlson process, it is necessary to repeat the copying cycle, and accordingly, prior to applying the sensitizing charge, the plate is charged to a polarity opposite to that of the sensitizing charge; and after charging, light is irradiated on the whole surface, and thereafter, a sensitizing charge is made, followed by image exposure. According to this process, the photosensitive plate is revived, however, the obtainable electrostatic contrast is only 300–500 volts, which is almost the same as that obtainable with photosensitive plate which has no overcoating layer. According to the process of U.S. Pat. No. 3,041,167, after the sensitizing charge, the light image is irradiated so that in the light exposed area, a carrier is injected from the conductive base side to weaken the external field, and contrast is obtained due to the difference of the capacitances between the exposed area and the unexposed area.

According to the present invention, a primary charge is held on the translucent insulating layer; and utilizing the field thereof, a firmly held charge layer is formed between and adjoining the photoconductive layer and the translucent insulating layer. The secondary charge and the image exposure are simultaneously made utilizing the external field of the held charge layer. Thereafter uniform light is irradiated on the whole surface of the translucent insulating layer, so that it is possible to use a translucent insulating layer having 10–15$\mu$ thickness and the layer can be formed by bonding of an insulating film regardless of the method for coating the resin, which means that the photosensitive plate can be sufficiently protected. With the use of the photoconductive layer having a thickness similar to or thicker than the thickness of the translucent insulating layer, it is possible to obtain electrostatic contrast of 1000–1500 volts.

An object of the present invention is to provide a process for forming an electrostatic image comprising using a photosensitive plate composed of a translucent insulating layer overlayed on a photoconductive layer which covers a conductive base; charging the translucent insulating layer positively or negatively by the use of electrodes or corona discharge; forming a surface potential difference according to the light-and-dark pattern of the original image on the translucent insulating layer by applying thereon corona discharge having a polarity oppositive to said primary charge simultaneously with the exposure of the original image; and thereafter converting the surface potential difference and increasing the difference thereof by irradiating light uniformly over the whole surface of the translucent insulating layer to obtain thereon an electrostatic image of the original image having high contrast.

A further object of the present invention is to provide a process for electrophotography comprising visualizing the electrostatic image by a developer; transferring and fixing the visualized image on a transfer material to obtain an electrophotographic image of the original image; and after transferring the image, cleaning the surface of the insulating layer to enable repetitive use of the photosensitive plate.

The above objects and various other objects and the advantages of the present invention will become clear from the following detailed description, taken in conjunction with the accompanying drawings, in which:

FIG. 1 shows the fundamental structure of the electrophotographic plate used in the process of the present invention;

FIGS. 2, 3 and 4 schematically illustrate a process for forming electrostatic images on the photographic plate shown in FIG. 1;

FIG. 5-1 includes several diagrams showing the electrostatic charge pattern of the photographic or photosensitive plate according to the present invention;

FIG. 5-2 includes surface potential slots for the diagrams of FIG. 5-1;

Figure 1:
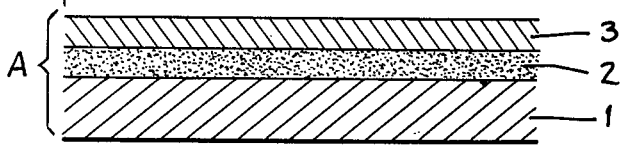

FIG. 1 shows the fundamental structure of an electrophotographic plate A used in the process for forming the electrostatic image of the present invention, in which 1 is the base, 2 is the photoconductive layer which is coated using a coater or wheel or by spraying the base 1, and if necessary, a little amount of binder material composed mainly of resin or the like can be added in order to obtain better binding effect between the layers. Layer 3 is a translucent insulating layer which is tightly bound on the photoconductive layer 2. Thus, the electrophotographic plate A is composed essentially of a base 1, a photoconductive layer 2, and an insulating layer 3. It is noted that as used herein "translucent" means transparent, semi-transparent and translucent to activating radiation.

The base 1 is formed of a conductive material.

Metals such as tin, copper and aluminum can be used, and in particular the base obtained by adhering aluminum foil on paper is not only economical but also convenient, as this base can be wound on a drum.

As to the material which composes said photoconductive layer 2, CdS (cadmium sulfide), CdSe (cadmium selenide), ZnO (zinc oxide), Se (selenium), $TiO_2$ (titanium dioxide), and SeTe (selenium telluride) can be used. The above-mentioned materials can be used by coating the same on the base, or by mixing the same with a binder, or by mixing two or three kinds of the above-mentioned substances.

Among the above-mentioned photoconductive materials, high sensitivity photoconductors especially adopted for the present invention, are CdS, or other like high sensitivity photoconductors, and when these materials are used, the sensitivity can be raised to over ASA 100.

The photoconductive layer obtained by adding a small amount of ZnS to the main component CdS, is highly sensitive, and it is possible to obtain an electrostatic image of high contrast. Conventional photoconductive layers similar to the above-mentioned photoconductive layer of the present invention, such as a mixture of CdS and ZnS, have been used in the P.I.P. system, and in conventional photoconductive layers of this type the ratio of CdS to ZnS has been selected within the range of 4:6 to 3:7 in order to maximize the persistent internal polarization characteristics, and the difference between the photopolarization and dark polarization. However, in accordance with the present invention, the ratio of CdS to ZnS is preferably within the range of 50:1 to 1:1, and it is possible to fully utilize the high sensitivity of CdS.

Further, according to the process of the present invention, as is discussed hereinafter, an electrostatic image is formed on the surface of the insulating layer by making use of the charge held persistently on the photoconductive layer of a photosensitive plate composed by overlaying an insulating layer on a photoconductive layer, and according to this invention, it is possible to employ photoconductive materials of low resistivity which cannot be used with conventional methods because the conventional photoconductive layer itself must hold the charge, and additionally, according to this invention, it is possible to employ known photoconductive materials in general even if photoconductors of high sensitivity are not used.

As to a photoconductive paper of zinc oxide dispersed in a resin, as in the Electro Fax system, it is necessary that the photoconductive paper be white because it is itself used as the copying paper. Therefore, it is not possible to add too much dye to increase sensitivity. However, in accordance with this invention, the photosensitive plate is not itself used as the copying paper, but the electrostatic image is transferred to a transfer sheet, and as it is not necessary that the photosensitive plate be white, it is possible to add a much larger amount of dye as compared with the amount of the dye added in the conventional methods. Therefore, in accordance with this invention, it is possible to use a high sensitivity zinc oxide photoconductive layer having several times more sensitivity than conventional photoconductive layers.

Excellent results can also be obtained using photoconductive layers obtained by doping lithium on ZnO according to the method of this invention.

The materials which compose the insulating layer 3 may be any material which has these three factors, high abrasion resistance, high resistivity capable of holding electrostatic charge, and being translucent to actinic radiation. The films of fluorine resins, polycarbonate resins, polyethylene resins, polyester resins or the like, can be employed, and in particular, fluorine resins which are easily cleaned, are preferred materials because the photosensitive plate is used over again after the developing and transferring processes, as mentioned hereinafter.

The process for forming an electrostatic image on a translucent insulating layer 3 of the photosensitive plate A will now be explained.

Figure 2:
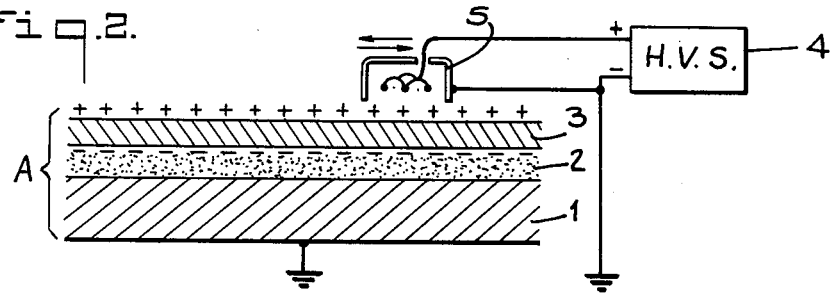

First, the surface of the translucent insulating layer 3 of the photosensitive plate A is charged in a dark or light area with a specific polarity, positive for example, by means of conventional charging means such as a corona discharger 5, or an electrode roller (not shown)

connected to the source 4 of high voltage, as shown in FIG. 2.

As mentioned above, where the surface of the insulating layer 3 is charged in the positive, the insulating layer 3 works as a condenser, and the charge opposite said charged polarity is stored internally between and adjoining the insulating layer 3 and the photoconductive layer 2. As to the charge, it is considered to be either a free carrier of the photoconductive layer 2, or a carrier injected from the conductive base 1, or a mixture of these carriers.

The accumulated carrier is trapped by the binder or the trap level of the photoconductor which comprises the photoconductive layer and corresponds to a charge of polarity opposite that on the surface of the insulating layer.

In the above-mentioned state, there is no chance of the charge escaping to an unexposed or dark area or to the exposed or light area for a long period of time. Besides, even if the charge on the surface of the insulating layer leaks onto an unexposed area, the internal charge is held.

Figure 3:
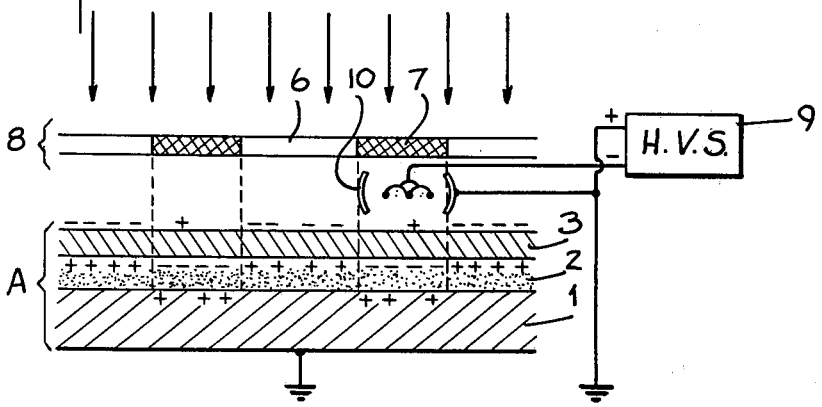

Next, as is shown in FIG. 3, the light image (by means of actinic radiation) of the original image 8 having the exposed area 6 and the unexposed area 7, is projected onto the translucent insulating layer 3 by means of a transmission or reflecting system and simultaneously the polarity opposite to said polarity charge, i.e., a negative corona discharge, is projected on the insulating layer 3 by means of a corona discharger 10 connected to the source of high voltage 9.

The polarity charge in the above-mentioned charging process is determined by the characteristics of the photoconductor. In other words, where the photoconductor is a photoconductive layer composed mainly of an n-type photoconductor such as CdS or ZnO activated by Cu, the primary charge is preferably in the positive and the secondary charge is in the negative. Where the photoconductive layer is composed mainly of a p-type photoconductor, it is preferable to charge the primary charge in the negative and the secondary charge in the positive. However, this is not an absolutely necessary condition, and even when it is charged in an opposite manner, it is possible to obtain an electrostatic image although contrast is deteriorated.

As the means for effecting the secondary charge simultaneously with the irradiation of the original image on the insulating layer 3 of the photosensitive plate, it is preferable to irradiate the original image on the photosensitive plate by using a corona discharger having a shield plate structure on the translucent upper portion, or an optically open type having no upper shield plate. For example, as shown in FIG. 3, the upper portion of the corona discharger 10 is optically open, and while charging the surface of the insulating layer with this corona discharger, the discharger is moved and the light image of the original image is irradiated on the insulating layer simultaneously through the corona discharger.

Alternatively, the original image and the photosensitive plate can be moved, the corona discharger being fixed.

It is preferable that the effective exposing or radiating area of the corona discharger defines the slot exposing area of the original image.

As mentioned above, radiation of the original image and the secondary charge steps are carried out simultaneously, the positive charge held on the translucent insulating layer 3 by the primary charge at the exposed area 6 of the original image being neutralized by the negative charge of the secondary charge, and further being charged in the polarity of the secondary charge. In this case, the photoconductive layer 2 loses resistivity because of the light irradiation, and becomes conductive, and the negative charge stored next to the translucent insulating layer 3 of the photoconductive layer 2 from the primary charge, becomes free, and is discharged by the electrical field of the secondary charge, and the positive charge is induced by the negative charge held on the translucent insulating layer 3. In the unexposed area, the positive charge formed on the surface of the translucent insulating layer 3 by the primary charge, is partially neutralized by the negative charge of opposite polarity of the secondary charge, but even if all of it is neutralized, the degree of charging in the polarity caused by the secondary charge is small. This shows that the effect of the external field caused by the persistent trap carrier is large.

As mentioned above, where the secondary charge is effected simultaneously with the radiation of the original image, the charge of the secondary charge polarity on the surface of the translucent insulating layer 3 is greater in the exposed area of the original image than in the unexposed area of the original image, but as mentioned above, in the exposed area of the original image, the positive charge is induced within the photoconductive layer 2, and therefore, the charge field on the surface of the translucent insulating layer 3 is considerably effected in this direction, and the strength of the field which the charge on the surface of the translucent insulating layer 3 imparts externally is comparatively weakened. On the other hand, in the unexposed area of the original image, a charge of the same polarity as the charge on the surface of the translucent insulating layer 3 by the secondary charge is induced, and therefore the field of charge is strengthened to effect externally, and as a result thereof, the field of the charge effecting externally becomes stronger in the unexposed area of the original image than in the exposed area. In other words, the surface potential of the translucent insulating layer 3 in the unexposed area becomes higher than that in the exposed area.

Figure 4:
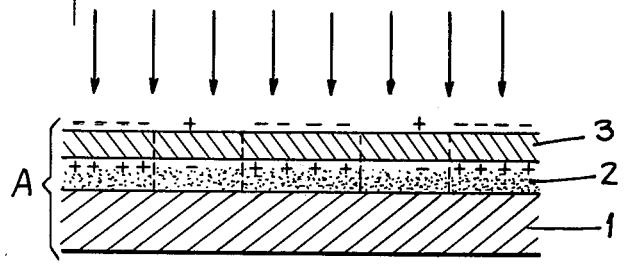

Next, in the case where light is irradiated all over the surface of the translucent insulating layer 3 wherein the above-mentioned electrostatic image is formed, in the exposed area of the original image not as much charge of the photosensitive plate A is observed, and the surface potential of the translucent insulating layer 3 remains almost constant. However, in the unexposed portion of the said original image, no exposure was effected in the above-mentioned step, and therefore the photoconductive layer 2 showed high resistivity, but in this step, the amount of resistivity is abruptly lowered because the exposure is carried out, and layer 2 become conductive. Therefore, the negative charge previously trapped internally is discharged to the conductive supporter, and the positive charge is induced in the photoconductive layer 2 by the negative charge on the surface of the translucent insulating layer 3, with the result that the surface potential of the translucent insulating layer 3 is lowered abruptly, and the field of the charge caused by the negative charge bound on the surface thereof is strongly actuated in the direction of the positive charge, and the external field of the surface charge becomes remarkably small. On the other hand, where the external field caused by the trap charge is very strong, the external field on the surface is in the negative even when the charge of the first positive charge is not totally neutralized. In this case, when light radiation is made on the whole surface, the internal trap field is released to give the positive potential on the surface, and high electrostatic contrast composed of positive and negative is obtained. The electrostatic pattern of the photosensitive plate A after processing is shown in FIG. 4.

The change of state of the electrostatic image formed on the insulating layer is caused by the relative change in the amount of primary and secondary charge.

Figure 5:
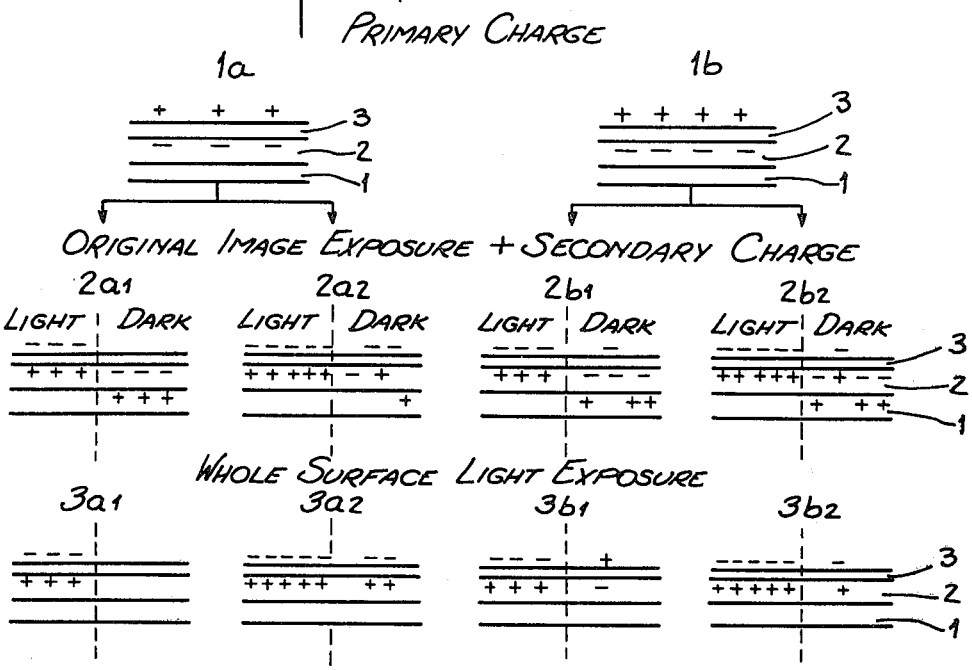
Figure 1:
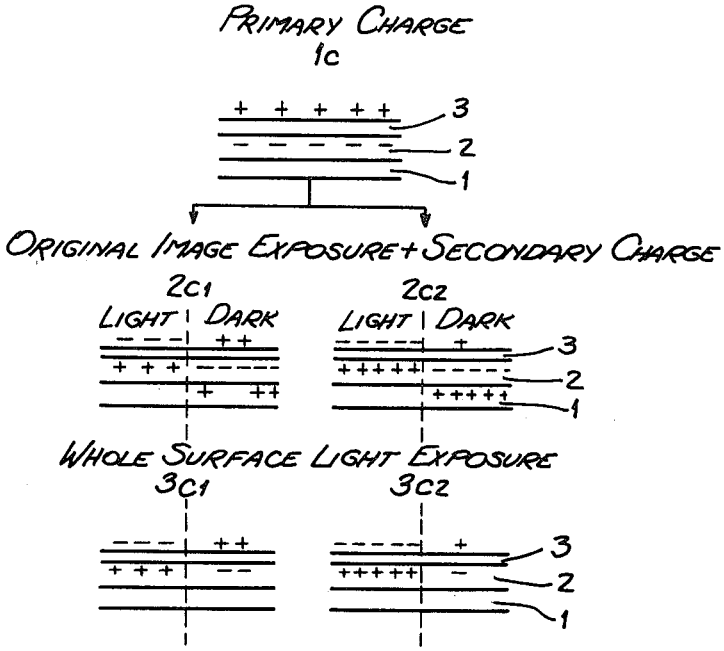
Figures 2, 5:
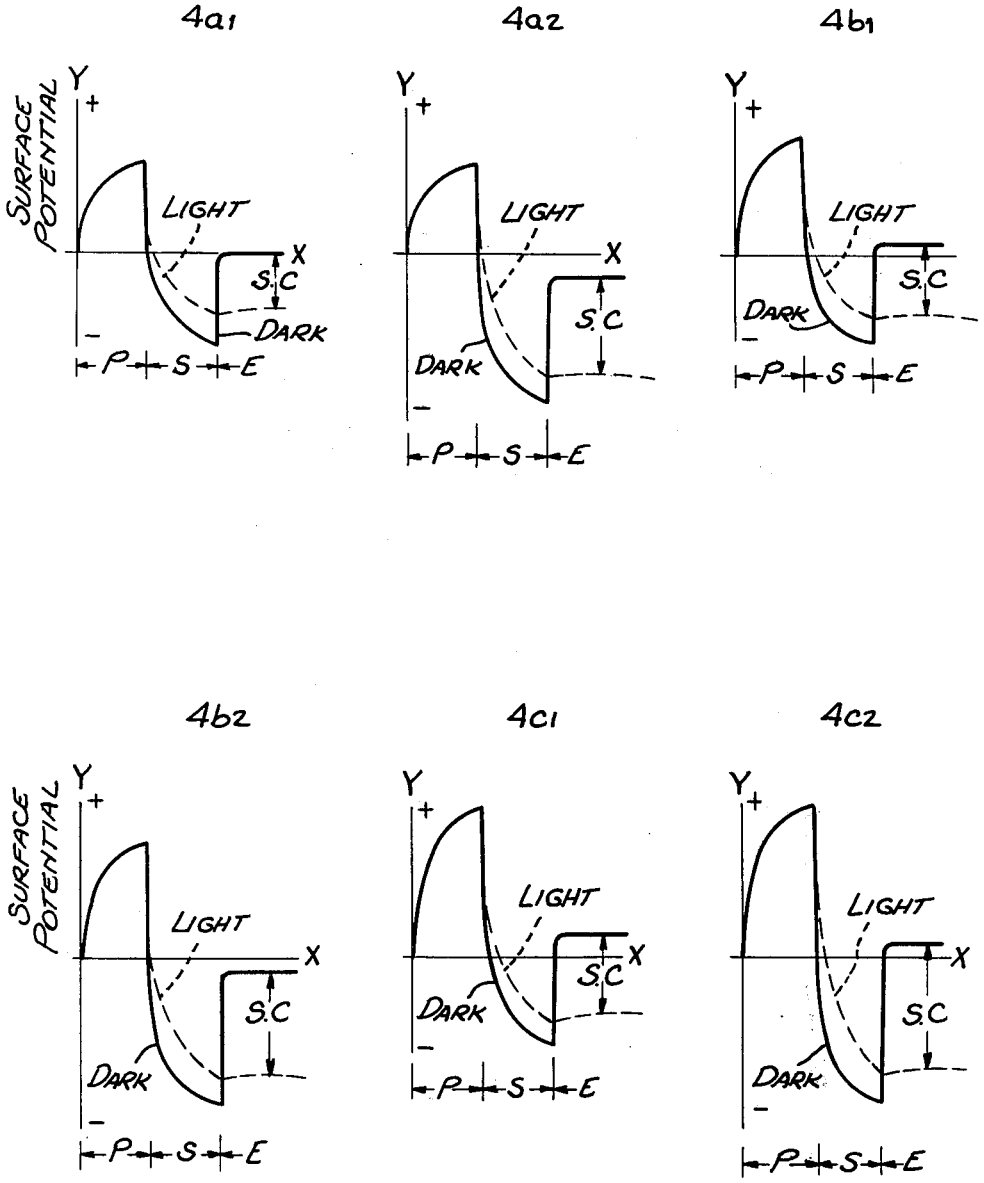

FIG. 5-1 shows the electrostatic charge pattern of the photosensitive plate and the state of the surface potential of the translucent layer, in the respective combinations thereof. FIGS. 5(1*a*, 1*b* and 1*c*) are classified in accordance with the amount of charge brought about at the time when the primary charge is made on the photosensitive plate, and 5(1*a*) shows a comparatively small charge, 5(1*b*) shows the intermediate degree, and 5(1*c*) shows considerably greater charge, and each of them shows the pattern of charge after the primary charge. FIG. 5(2a1, 2b1, and 2c1) and (2a2, 2b2, and 2c2), are classified in accordance with the amount of charge of the secondary charge and (2*a*1, 2*b*1, and 2*c*1) shows the case when it is comparatively smaller, and (2*a*2, 2*b*2, and 2*c*2) shows the case when it is comparatively greater, and they respectively show the charge pattern of the photosensitive plate.

In FIG. 5-2, diagrams 4*a*1, 4*a*2, 4*b*1, 4*b*2, 4*c*1 and 4*c*2, respectively show the state of the surface poential of the insulating layer in the respective processes for the photosensitive plate corresponding to *a*1, *a*2, *b*1, *b*2, *c*1 and *c*2, respectively.

The following explanations are for the case when the primary charge is positive.

In the case where a positive corona discharge of a comparatively small amount is applied onto the insulating layer as shown in 1*a*, the positive charge being held on the surface of the insulating layer is shown in FIG. 5-1*a*. Simultaneously, the same amount of the charge of polarity opposite to that of the primary charge is trapped and accumulated on the boundary surface with the insulating layer within the photoconductive layer, or adjoining thereof. Then the original image is irradiated thereto and simultaneously the charge of the polarity opposite to the polarity of the primary charge is carried out by means of a negative corona discharge. In this case, when the charge carried out is comparatively small, the surface charge of the photosensitive plate at the unexposed or dark area is neutralized, but the charge accumulated on the photosensitive layer remains trapped because the photoconductive layer is not in the conductive state, and at the same time a charge of polarity opposite to that of the trapped one is induced on the conductive base. On the other hand, at the exposed or light area of the original image, the photoconductive layer is conductive, the charge of the surface of the insulating layer and the charge on the photoconductive layer are converted to the opposite polarity. Next, the charge within the photoconductive layer of the unexposed portion is neutralized by the charge of the photoconductive base because the photoconductive layer is charged by irradiation over all the surface of the photosensitive plate, but at the exposed area, the charge within the photoconductive layer is restricted by the charge of the surface of the insulating layer, and therefore it retains the same state.

The diagram in FIG. 5-4a1 shows the surface potential of the insulating layer in accordance with the abovementioned processes. This diagram shows time on X axis, and surface potential on Y axis. In FIG. 5-4a1, P stands for the primary charge, and S stands for the secondary charge and the radiation of the original image, and E stands for the radiation of the whole photosensitive plate, and S.C stands for the contrast of the electrostatic image finally formed on the surface of the insulating layer.

Where the insulating surface is initially charged in the positive, the surface potential is built up in the region of the positive as is shown in P, and then charging of the positive potential is stopped; simultaneously with this stoppage or after an appropriate time, a negative corona discharge and the radiation of the original image are carried out as shown by S, then a negative side potential is built up at the exposed area of the original image as shown by the dotted line, while at the unexposed area, a negative potential is built up with a time constant which is smaller than that of the exposed area as shown by the solid line, since at the unexposed area, the internal trapped charge is released by the exposure simultaneously with the quick neutralization of the negative charge by the positive charge. In other words, the photoconductive layer must be charged to be conductive and the time constant is determined by the capacitance of the insulating layer. On the other hand, at the unexposed area, the negative corona discharge neutralizes the positive surface potential, and the internally held negative charge remains. Therefore, the field works externally of the negative, internally held charge. Where the negative charge is imparted on a part of the surface, the total field of the surface charge and the internal charge works as the external field. With irradiation on the whole surface of the photosensitive plate, the exposed area experiences no change of potential, but at the unexposed area the internally held charge is released and an abrupt attenuation of potential is generated, and a large electrostatic contrast is brought about between the exposed area and the unexposed area (E).

In the case of b1, c1, and c2, which is described hereinafter, at the unexposed area, the positive charge imparted by the primary charge is neutralized by the negative corona charge, but when it is neutralized to a certain degree, it proves difficult to further neutralize the primary charge by the external field, because of the large internally held charge, and this is considered to be the main reason why a latent image of high contrast is obtained in accordance with the present invention.

Next, where the secondary charge is comparatively greater as shown in 2a2, at the unexposed area, the primary charge is offset by the secondary charge and since the negative charge is greater, a negative charge equal to the difference between the negative and positive charges remains. And at the exposed area, the polarity is converted but the amount of charge thereof becomes much greater. As a whole, the electrostatic image is formed as a pattern composed of the density of the negative charge. 4a2 is the diagram which shows the state of the surface potential verses time.

In the same manner where the primary charge of an intermediate degree and the secondary charge is less than the charge of the primary charge remaining at the unexposed portion as shown in 1b-2b1-3b1-4b1, the electrostatic image, as a whole, becomes the pattern wherein the positive charge and the negative charge are coexistant, and where the secondary charge is comparatively greater as shown in 1b-2b2-3b2-4b2, an electrostatic pattern composed of the density of charge of the same polarity as in the case of 4a2, is obtained.

The diagrams 1c-2c1-3c1-4c1 show the case where the primary charge is greater and the secondary charge is smaller. The diagrams 1c-2c2-3c2-4c2 show the case wherein the secondary charge is greater. And in these cases, an electrostatic image composed of the densities of the different polarities can be obtained in the same manner.

As is apparent from the above explanations, the greater the primary charge and the secondary charge, the greater the electrostatic contrast which can be obtained.

However, although it is not shown in the diagrams, when the secondary charge is further increased, the contrast is decreased. The reason for this is not known, but it is suggested that the decay of the internal trap charge is accelerated by the charge field and the corona potential of the secondary charge, with the result that the second corona charge is generated even at the unexposed area, the value thereof being determined by the value of the internal trap charge.

The formation of electrostatic image in accordance with the present invention comprises, as mentioned above, charging the surface of the insulating layer while maintaining equilibrium with the charge induced on the photoconductive layer on the reverse side thereof; and by means of the mutual effects of these charges, a surface potential difference is formed on the surface of the insulating layer, and further an electrostatic image is formed in accordance with the light-and-dark pattern of the original image by exposing the whole surface, and therefore the electrostatic image of the present invention has a greater surface potential difference and stronger external field when compared with the electrostatic image formed by the conventional methods, and the sensitivity is greatly increased.

Figure 6:
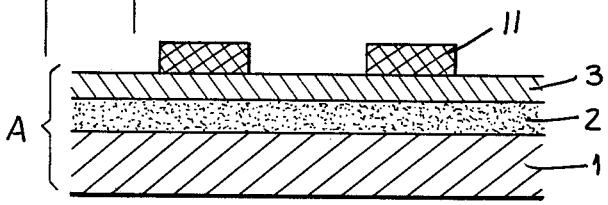
FIG. 6 shows a visible image obtained according to the present invention.

The electrostatic image which is formed as mentioned above, is processed through developing, transferring, and cleaning, and the photosensitive plate can be repeatedly reused. The electrostatic image obtained in accordance with the above-mentioned method, is developed with a developer composed mainly of charged colored particles by means of cathode development, magnetic brush development, powder cloud development, or the like conventionally known methods for development, to obtain a visible image as shown in FIG. 6. The electrostatic image formed on the surface of the insulating layer has high electrostatic contrast when compared with the conventional Carlson process, when it is developed in accordance with the cascade method, it is preferable to use an especially heavy carrier, i.e., the carrier described in assignee's copending Japanese Patent Application No. 42138/1965 which is obtained by coating the surface of the metal or nonmetal particles, the weight thereof being over 0.3 mg, with a resin including a uniform charge control agent.

On the other hand, where the magnetic brush development method is adopted, excellent results can be obtained with iron filings coated with a resin in order to prevent the surface charge of the high insulating layer from being discharged through the carrier.

With any of the above-mentioned methods for development, the electrostatic image can be formed on the surface of the insulating layer as mentioned above, and it is possible to form electrostatic patterns in the positive and the negative, and at the same time an electrostatic image of remarkably high contrast can be obtained, and therefore the visible image of remarkably high density is produced. Where a liquid development method is adopted, halogenated hydrocarbons (such as Freon or the like), dimethyl polysiloxane (silicon oil) or like oils of high insulating properties can be employed by dispersing pigments or dyes into the same.

Figure 7:
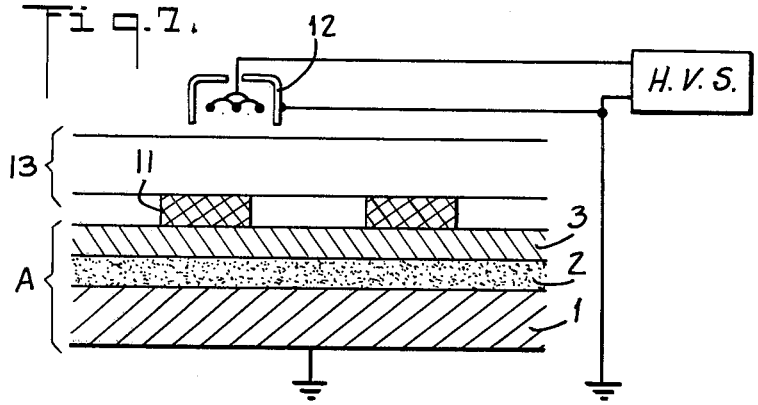
FIG. 7 shows a process of the present invention wherein an external voltage is applied onto the photosensitive plate.

The visible image 11 formed on the surface of the insulating layer is transferred onto a transferring material 13 (FIG. 7) such as paper without imparting any electric field from outside by closely contacting the transfer sheet having an electrostatic capacity larger than the electrostatic capacity of the photoconductive material of the photosensitive plate, on the surface on which the electrostatic image is formed, as described in assignee's copending Japanese Patent Application No. 42139/1965 or other known methods according to which the external voltage 12 such as corona discharge or bias voltage or the like is applied as shown in FIG. 7. Finally, the transferred image is fixed by infrared radiation to obtain the electrostatic image.

The photosensitive plate is cleaned after the transfer process is completed, by means of conventional cleaning methods such as a fur brush or the like or by the method described in assignee's copending U.S. Patent Application Ser. No. 585,091, whereby the plate is directly rubbed with an elastic body, and the charged particles remaining on the surface of the photosensitive plate are removed. When cleaning is carried out after discharging the charge of the electrostatic image formed on the surface of the insulating layer at the exposed area of the original image mainly by means of the secondary charge, the cleaning effect is increased. For this purpose, an alternating current discharge made on the surface of the insulating layer before the cleaning operation is carried out to remove the charge of the electrostatic image, and then cleaning is carried out using, for example, a fur brush, and excellent results are obtained. In this case it is possible to increase the cleaning effect by imparting to the fur brush a potential of polarity opposite to that of the charged color particles. In this case, it is also possible to replace the primary charge.

Since the cleaning effect depends on properties of the material of the insulating layer (in particular, the adhesive characteristics), and the above-mentioned resins are all preferable as materials for forming an electrostatic image in accordance with the present invention, and among all these resins, fluorine resin film has excellent non-adhesive characteristics, which promotes the removal of the charged color particles when cleaning, and the cleaning effect is excellent. In this respect, this is a preferred material.

The thickness of the translucent insulating layer 3 affects, along with the photoconductive layer, the quality of the electrostatic image. In particular, the sensitivity, contrast, and durability of the photosensitive plate are affected. It has been found that a photosensitive plate having the translucent insulating layer thickness within the range of from 10 to 50$\mu$ is quite durable and forms excellent electrostatic images.

Where the insulating layer is very thin, i.e., less than 10$\mu$, it is subject to pin holes and unevenness of the thickness, and it is very difficult to obtain an insulating layer of high quality.

Further, in the development of the latent image or in the transfer process, concaved and convexed portions are formed on the surface of the insulating layer by the carrier, and where the insulating layer is very thin, a dielectric breakdown may occur at the concaved portion of the surface of the insulating layer by the application of a high electrical field in the charging step, and at the same time it is easy to form pin holes and accelerate the dielectric breakdown as a result of the generation of holes.

When pin holes exist in the insulating layer, discharge occurs at the pin holes during the secondary charge process, and the surrounding areas of the pin holes are charged in the opposite polarity. This causes a foggy image. Generally speaking, the surface of the insulating layer is burnt by corona discharge in the charge process, and so-called corona deterioration is brought about. In regard to this, when the insulating layer is very thin, the deterioration is accelerated in inverse proportion to the thickness thereof by the applied high electrical field, and as a result thereof the photosensitive plate cannot stand use for a long period of time.

In order to obtain a photosensitive plate which can stand long repetitive use, and in order to obtain an excellent image by preventing the above-mentioned phenomena, it has been discovered that the thickness of the translucent insulating layer should be more than 10μ.

In order to solve the above-mentioned problems, the thickness of translucent layer should be preferably thicker, but when the insulating layer becomes too thick, fogginess of the electrostatic image is brought about, and the contrast of the image deteriorates.

When the insulating layer is too thick, since little charge is trapped in the photoconductive layer in the primary charge and the external field on the surface of the insulating layer caused by the trap change is weak, the ratio of the charge of the secondary charge on the surface of the insulating layer becomes greater at the unexposed area of the original image, when the secondary charge of the polarity opposite to the polarity of the primary charge is made simultaneously with or just after the radiation of the original image, and as a result thereof, the contrast of the electrostatic image deteriorates because the surface potential difference from the exposed portion of the original image is decreased. Further, when the surface of the insulating layer is uniformly exposed after the above-mentioned step, the external field is not as greatly increased because the charge by the secondary charge is held on the surface of the insulating layer even if the charge trapped on the photoconductive layer in the unexposed area of the original image is eliminated, and therefore, the surface potential difference from the exposed area of the original image is not as great, and it is impossible to expect an increase of the contrast of the electrostatic latent image.

Therefore, in order to obtain a clear electrostatic image of high contrast, there is a restriction on the thickness of the translucent insulating layer. It has been found that a clear electrostatic image of high contrast can be obtained where the thickness of the translucent insulating layer is less than 50μ.

A photoconductive layer of the photosensitive plate which comprises a mixture of high photoconductive substances of cadmium sulfide (CdS) or selenide (CdSe) and a vinyl resin bonding agent at the weight ratio of ½ to 1/10, is capable of producing high sensitivity and high contrast in accordance with the present invention. The relation between the thickness of the translucent insulating layer and the contrast of the electrostatic image at the exposed area of the original image is shown in FIG. 8.

Figure 8:
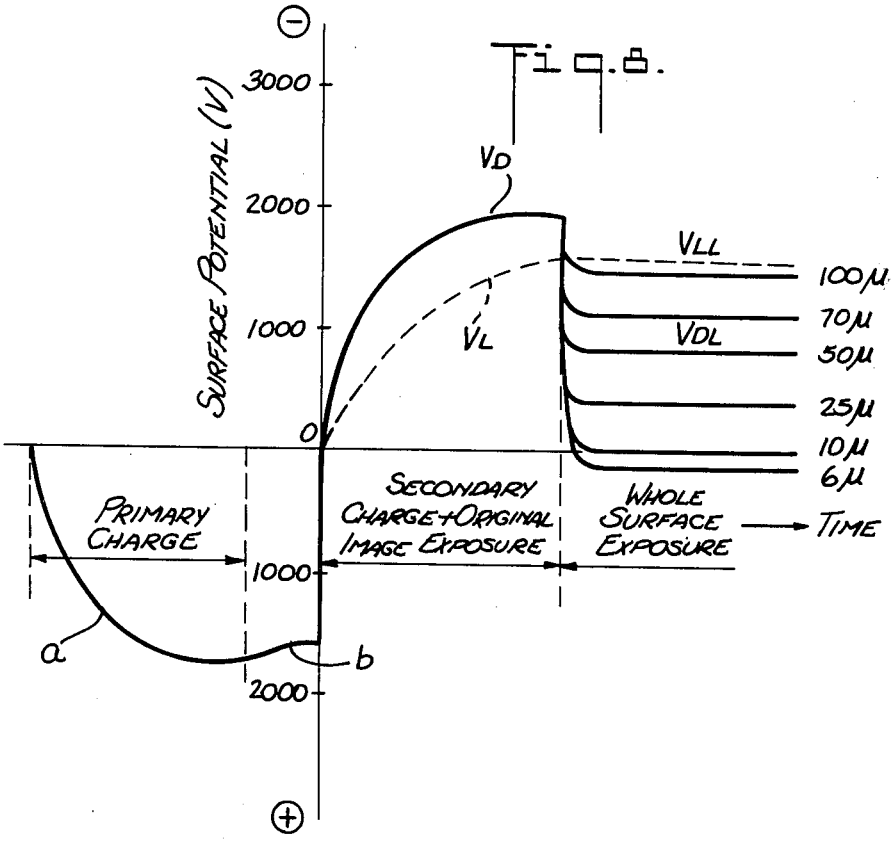
FIG. 8 shows the states of charge of the various stages of the present invention.

When the corona discharge of positive polarity or positive potential is applied to the translucent insulating layer 3 of the photosensitive plate, the surface potential of said translucent insulating layer 3 increases as a function of time, and the specific characteristics can be presented by the curve *a* in FIG. 8.

After the primary charge, the surface potential of the insulating layer 3 decreases somewhat as shown by the curve *b* in FIG. 8, but when the corona discharge of the negative polarity which is of polarity opposite to the polarity of the primary charge, is irradiated simultaneously with the irradiation of the original image, the surface potential of the insulating layer 3 takes the specific characteristic $V_L$ at the exposed area of the original image and the specific characteristic $V_D$ at the unexposed area of the original image as shown in FIG. 8. The whole surface of said insulating layer is irradiated with radiation, $V_D$ and $V_L$, respectively, and taking a specific characteristic such as $V_{DL}$ and $V_{LL}$, $V_{LL}$ being higher than $V_{DL}$, which are reversed when compared with the above-mentioned process, the difference between them is increased. Thus, on the surface of the insulating layer 3, an electrostatic image having the contrast of the surface potential difference $V_{LL}-V_{DL}$ is formed.

$V_D$ and $V_L$ of FIG. 8 show the characteristics presented where the thickness of the translucent insulating layer is 50μ, and said characteristics can be changed in accordance with the thickness of the translucent insulating layer, and where the secondary charge potential is made constant, there is a tendency for the surface potential to be increased as the translucent insulating layer thickness is increased. However, when the thickness of the translucent insulating layer becomes too great, the difference between the surface potential $V_D$ at the unexposed area and the surface potential $V_L$ decreases, and the contrast of the electrostatic image deteriorates.

It has been found that when the thickness of the translucent insulating layer is less than 50μ, it is possible to obtain excellent contrast.

On the other hand, the surface potential difference $V_{LL}-V_{DL}$ at the exposed area and the unexposed area of the original image when an overall exposure is carried out, is greatly affected by the thickness of the translucent insulating layer 3, and the difference thereof is increased when the translucent insulating layer is thinner as shown in FIG. 8.

In order to obtain excellent contrast, it is necessary to have a surface potential difference over 500 V, but where the thickness of the translucent insulating layer 3 is thicker than 50μ, it is impossible to satisfy this condition. On the other hand, when the thickness of the translucent insulating layer 3 is less than 50μ, the surface potential difference goes beyond 500 V and an electrostatic image of high contrast can be produced.

It has been found that the preferred thickness of the photoconductive layer is within the range from 50 to 200μ.

In the above-mentioned experiments, the secondary charge was made simultaneously with the radiation of the original image, but almost the same results were obtained when the secondary charge was made immediately after the radiation of the original image.

EXAMPLE I 10g of an acryl type clear lacquer was added to 90g of cadmium sulfide activated by copper, and a small amount of thinner was added to the resulting mixture.

The mixture was made into paint form and coated on an aluminum plate having a thickness of about 1 mm. by means of a spray. A film of transparent fluorine resin of about 15μ, was adhered to the above obtained photoconductive coated surface.

A corona discharge of +6KV was made on the resulting fluorine resin film photosensitive plate and the positive charge was uniformly bound. Then, the original image was irradiated on the charged fluorine resin coated film surface using a 10 lux tungsten lamp for from 0.1 to 0.3 seconds. Simultaneously, a (−6KV) negative corona discharge was made thereon, and an electrostatic image was formed on the fluorine resin coated film. Thereafter, the whole surface of the said coated film was uniformly exposed for 1 to 2 seconds with a 10 W tungsten lamp to form an electrostatic image in accordance with the light-and-dark patterns of the original image. The electrostatic image was developed by means of the magnetic brush method, and a visible image of high image density and excellent quality without fog was obtained.

EXAMPLE II

Figure 9:
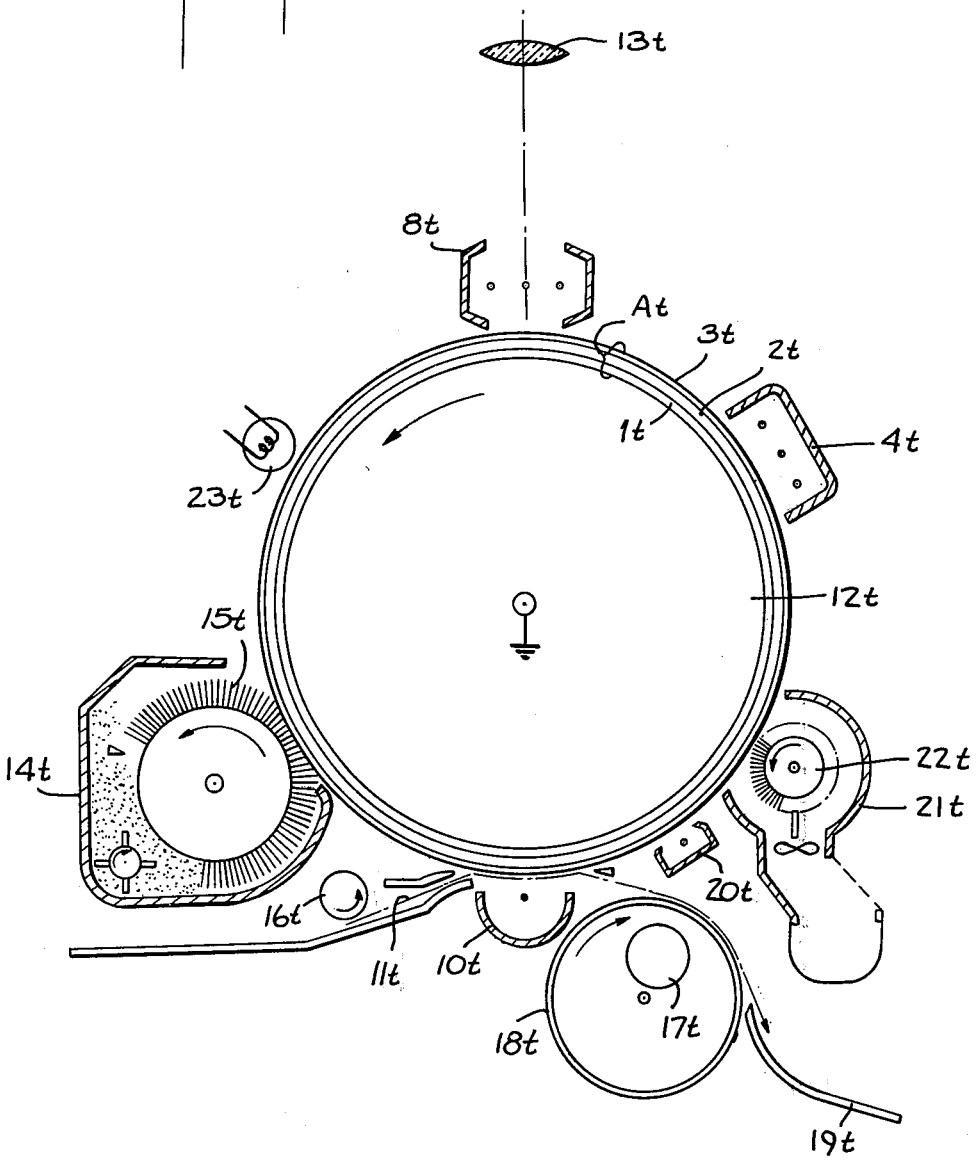
FIG. 9 illustrates a simplified embodiment of the copying device of the present invention.

FIG. 9 shows a copying device wherein the process of the present invention was applied. A drum 12*t* has photosensitive plate At overlaid on its periphery. The plate comprises conductive base 1*t*, photoconductive film 2*t*, and insulating film 3*t*. This drum is rotated in the direction shown by an arrow in the drawing.

The photosensitive plate At is given a primary charge by the corona discharger 4*t*, and the original copy image is projected by the lens 13*t* onto the surface of the insulating film 3*t*, which has been subjected to the primary charge, and simultaneously a secondary charge of polarity opposite to the primary charge is made by the secondary charger 8*t* to form the electrostatic image on the surface of insulating film $\mathbf{3}_t$. The effective exposing area of the corona discharger defines the slit exposure of the plate; and then the whole surface of the insulating film is uniformly exposed by the tungsten lamp $\mathbf{23}_t$ to form the electrostatic image in accordance with the light-and-dark pattern of the original image. The electrostatic image is developed by means of the magnetic brush $\mathbf{15}_t$ of developer $\mathbf{14}_t$, which brushes charged colored particles, forming a visible powder image. Thereafter, the visible powder image is transferred by applying a corona discharge of the polarity opposite to the charged particles using the corona discharger $\mathbf{10}_t$ to the transfer material $\mathbf{11}_t$ which is contact-moved with the visible powder image by the send-roller $\mathbf{16}_t$. Then the transferred image on material $\mathbf{11}_t$ is moved along the periphery of the hot drum $\mathbf{18}_t$ having an infrared lamp $\mathbf{17}_t$ therewithin, and the transfer image is thus fixed. Finally, the electrophotographically copied image is obtained in receiver $\mathbf{19}_t$.

After the transfer of the image, any electrostatic image-forming charge remaining on the insulating coated film surface $\mathbf{3}_t$ is removed by an alternating current discharger $\mathbf{20}_t$; and it is then brushed at the cleaner $\mathbf{21}_t$ with soft rotary brush $\mathbf{22}_t$ such as a fur-brush, and any powder image remaining on the insulating coated surface $\mathbf{3}_t$ is cleaned and the photosensitive plate is ready for reuse.

As has been explained so far, in accordance with the present invention, precharging is made on the surface of the insulating coated film of a photosensitive plate composed of the three layers, i.e., a conductive base, a photoconductive coated film, and an insulating coated film; and then the corona discharge of the polarity opposite to the pre-charge is irradiated simultaneously with the image irradiation, while keeping the equilibrium relation with the electric charge induced within the photoconductive coated film on the insulating coated film; and an electrostatic image is formed on the surface of the insulating coated film by the mutual effect of the two. The whole surface of the coated film is uniformly exposed, and therefore an electrostatic image having large surface potential differences and strong external charge fields can be obtained. The sensitivity is thus greatly increased. An electrostatic image is formed on the insulating film, and the processes of the developing, transferring, and cleaning are carried out. Therefore, by selecting an insulating film having high resistance and high anti-abrasion, there is almost no chance of damage and deterioration, and as it is possible to prevent the deterioration of the surface of the internal photoconductive film, it is possible to obtain a chargeable member which can withstand permanent long term, repetitive use.

It is apparent that the present invention can be modified by the expert in the art within the scope of the disclosure herein and the following claims.

We claim:

1. A process for forming an electrostatic image on a photosensitive plate having a conductive base, a photoconductive layer overlying said base and an insulating layer overlying said photoconductive layer, said process comprising the steps of:

a. applying a first charge substantially uniformly onto said insulating layer, b. exposing said photoconductive layer to a pattern of image light while applying a charge of a polarity opposite to that of said first charge onto said insulating layer, and then, c. uniformly exposing said photoconductive layer to light to which said photoconductive layer is sensitive.

2. A process for forming an electrostatic image on a photosensitive plate having a conductive base, a photoconductive layer overlying said base and an insulating layer overlying said photoconductive layer, said process comprising the steps of:

a. applying a first charge substantially uniformly onto said insulating layer, b. exposing said photoconductive layer to a pattern of image light while applying a corona discharge of a polarity opposite to that of said first charge onto said insulating layer, and then, c. uniformly exposing said photoconductive layer to light to which said photoconductive layer is sensitive to improve the quality of said latent image.

3. A process for forming an electrostatic image on a photosensitive plate having a conductive base, a photoconductive layer overlying said base and exhibiting p-type or n-type semiconductivity and an insulative layer overlying said photoconductive layer, said photosensitive plate being characterized in having carrier charge of a polarity corresponding to the conductivity type of said photoconductive layer injectable from said conductive base into said photoconductive layer and bound in the region of the interface between said insulative and photoconductive layers, said process comprising the steps of:

a. applying a first charge of a polarity opposite to the conductivity type of said photoconductive layer substantially uniformly onto said insulative layer to inject and bind carrier charge in the region of the interface between said insulative and photoconductive layers, b. then exposing said photoconductive layer to a pattern of image light while applying a corona discharge of a polarity opposite to that of said first charge onto said insulative layer, and then, c. exposing said photoconductive layer to activating light to discharge bound carrier charge remaining in the region of said interface and form a high contrast electrostatic image.

4. A process according to claim 3, wherein the thickness of said insulative layer is between 10 and 50$\mu$.

5. A process according to claim 3, wherein said insulative layer is transparent to both said image light and said activating light, and said photoconductive layer is exposed to said image light and said activating light through said transparent insulative layer.

6. A process according to claim 3, wherein said photoconductive layer comprises a mixture of CdS and binder which is characterized in having carrier charge injectable therein from said conductive base.

7. A process according to claim 3, wherein said photoconductive layer comprises Se - Te.

8. A process according to claim 3, wherein said insulative layer comprises a polyester resin.

9. A process according to claim 3, wherein the effective exposing area of the corona discharge defines a slit exposing area of said pattern of image light exposed to said photoconductive layer.

10. A process for forming an electrophotographic image on a photosensitive plate having a conductive base, a photoconductive layer overlying said base and exhibiting p-type or n-type semiconductivity and an insulative layer overlying said photoconductive layer, said photosensitive plate being characterized in having carrier charge of a polarity corresponding to the conductivity type of said photoconductive layer injectable from said conductive base into said photoconductive layer and bound in the region of the interface between said insulative and photoconductive layers, said process comprising the steps of:

a. applying a first charge of a polarity opposite to the conductivity type of said photoconductive layer substantially uniformly onto said insulative layer to inject and bind carrier charge in the region of the interface between said insulative and photoconductive layers, b. then exposing said photoconductive layer to a pattern of image light while applying a corona discharge of a polarity opposite to that of said first charge onto said insulative layer and then, c. exposing said photoconductive layer to activating light to discharge bound carrier charge remaining in the region of said interface and form a high contrast electrostatic image, d. visualizing said electrostatic image by applying a developer onto said insulative layer, e. transferring said visualized image onto a transfer sheet and fixing the visualized image, and f. cleaning the surface of said insulative layer to remove residual developer and enable the repetitive use of said photosensitive plate.

11. A process according to claim 10, wherein said visualized image is transferred by physically pressing said transfer sheet against said insulative layer in the absence of an external electric field.

12. A process according to claim 10, wherein the thickness of said insulative layer is between 10 and 50$\mu$.

13. A process according to claim 10, wherein said photosensitive plate is subjected to another corona discharge immediately before cleaning.

14. A process according to claim 10, wherein during the cleaning of said photosensitive plate a charge is established relative to said photosensitive plate to facilitate the removal of residual developer.

15. A process for forming an electrostatic image having areas of opposite polarity corresponding to the light and dark image patterns of an original to be copied comprising the steps of:

a. applying a first predetermined charge onto a photosensitive plate having a conductive base, a photoconductive layer overlying said base and an insulative layer overlying said photoconductive layer;

b. then exposing said photoconductive layer to the light and dark image patterns of said original while applying a second charge onto said insulative layer, said second charge being applied in an amount relative to said first predetermined charge so that in areas exposed to the light image patterns of said original said first charge is neutralized and replaced with a charge of a polarity opposite to that of the first charge, and that in areas exposed to the dark image patterns said first charge is not completely neutralized; and then c. exposing said photoconductive layer to activating light to form a high contrast electrostatic image having areas of opposite polarity corresponding to the light and dark image patterns of said original to be copied.

16. A process for forming an electrostatic image having areas of opposite polarity corresponding to the light and dark image patterns of an original to be copied comprising the steps of:

a. applying a first predetermined charge onto a photosensitive plate having a conductive base, a photoconductive layer overlying said base and exhibiting p-type or n-type semiconductivity, and an insulative layer overlying said photoconductive layer, said photosensitive plate being characterized in having carrier charge of a polarity corresponding to the conductivity type of said photoconductive layer injectable from said conductive base into said photoconductive layer and bound in the region of the interface between said insulative and photoconductive layers, said first predetermined charge being of a polarity opposite to the conductivity type of said photoconductive layer to inject and bind carrier charge in the region of the interface between said insulative and photoconductive layers;

b. then exposing said photoconductive layer to the light and dark image patterns of said original while applying a corona discharge onto said insulative layer, said corona discharge being applied in an amount relative to said first predetermined charge so that in areas exposed to the light image patterns of said original said first charge is neutralized and replaced with a charge of a polarity opposite to that of the first charge, and that in areas exposed to the dark image patterns said first charge is not completely neutralized; and then c. exposing said photoconductive layer to activating light to discharge bound carrier charge remaining in the region of said interface and form a high contrast electrostatic image having areas of opposite polarity corresponding to the light and dark image patterns of said original to be copied.

17. An apparatus for forming an electrostatic image having areas of opposite polarity corresponding to the light and dark image patterns of an original to be copied comprising:

a. a photosensitive plate having a conductive base, a photoconductive layer overlying said base, and an insulative layer overlying said photoconductive layer;

b. charging means for applying a first predetermined charge uniformly onto said insulative layer;

c. first means for exposing said photoconductive layer to light and dark patterns of said original whle applying a second charge onto said insulative layer, said first means including means for applying said second charge in an amount relative to said first predetermined charge so that in areas exposed to the light image patterns said first charge is neutralized and replaced with a charge opposite to that of said first charge, and that in areas exposed to the dark image pattern said first charge is not completely neutralized; and d. second means for thereafter exposing the photoconductive layer to activating light to form a high contrast electrostatic image having areas of opposite polarity corresponding to the light and dark image patterns of said original image to be copied.

18. An apparatus for forming an electrostatic image having areas of opposite polarity corresponding to the light and dark image patterns of an original to be copied comprising:

a. a photosensitive plate having a conductive base, a photoconductive layer overlying said base and exhibiting p-type or n-type semiconductivity, and an insulative layer overlying said photoconductive layer, said photosensitive plate being characterized in having carrier charge of a polarity corresponding to the conductivity type of said photoconductive layer injectable from said conductive base into said photoconductive layer and bound in the region of the interface between said insulative and photoconductive layers;

b. charging means for applying a first predetermined charge substantially uniformly onto said insulative layer, said first predetermined charge being of a polarity opposite to conductivity type of said photoconductive layer to inject and bind carrier charge in the region of the interface between said insulative and photoconductive layers;

c. first means for exposing said photoconductive layer to the light and dark image patterns of said original while applying a corona discharge onto said insulative layer, said first means including means for applying said corona discharge in an amount relative to said first predetermined charge so that in areas exposed to the light image patterns of said original said first charge is neutralized and replaced with a charge of a polarity opposite to that of the first charge, and that in areas exposed to the dark image patterns said first charge is not completely neutralized; and d. second means for exposing said photoconductive layer to activating light to discharge bound carrier charge remaining in the region of said interface and form a high contrast electrostatic image having areas of opposite polarity corresponding to the light and dark image patterns of said original to be copied.

19. An electrophotographic copying device which comprises:

charging means for applying a primary charge on the surface of a photosensitive plate, which plate comprises a base, a photoconductive layer and a translucent insulating layer overlaid thereon;

means for simultaneously exposing an original image and for applying a corona discharge onto the surface of said charged insulating layer;

means for forming a high contrast static image of the original image on the surface of said insulating layer by uniformly irradiating the whole surface of said insulating layer, thereby activating the photoconductive layer;

developing means for visualizing said static latent image;

means for transferring said visualized image onto copying material; and cleaning means for removing residual developer from the surface of said insulating layer remaining after the transfer of the image, whereby the photosensitive plate is prepared for repeated use.

20. An electrophotographic copying device as claimed in claim 19, wherein the means for transferring the visible image formed on the surface of the insulating layer of the photosensitive plate onto the copying material comprises means for physically pressing said copying material against said insulating layer in the absence of an external electric field.

21. An apparatus for forming an electrostatic image comprising:

a. a photosensitive plate having a conductive base, a photoconductive layer overlying said base and exhibiting p-type or n-type semi-conductivity and an insulative layer overlying said photoconductive layer, said photosensitive plate being characterized in having carrier charge of a polarity corresponding to the conductivity type of said photoconductive layer injectable from said conductive base into said photoconductive layer and bound in the region of the interface between said insulative and photoconductive layers;

b. charging means for applying a first charge of a polarity opposite to the conductivity type of said photoconductive layer substantially uniformly onto said insulative layer to inject and bind carrier charge in the region of the interface between said insulative and photoconductive layers;

c. means for exposing said photoconductive layer to a pattern of image light while applying a corona discharge of a polarity opposite to that of said first charge onto said insulative layer; and d. means for exposing said photoconductive layer with activating light to discharge bound carrier charge remaining in the region of said interface and form a high contrast electrostatic image.

22. An apparatus according to claim 21, wherein said insulative layer is transparent to both said image light and said activating light, and wherein means (c) and (d) include means for exposing said photoconductive layer through said transparent insulative layer.

23. An apparatus according to claim 21, wherein the thickness of said insulative layer is between 10 and 50$\mu$.

24. An apparatus according to claim 21, wherein said photoconductive layer comprises a mixture of CdS and binder which is characterized in having carrier charge injectable therein from said conductive base.

25. An apparatus according to claim 21, wherein said photoconductive layer comprises Se - Te.

26. An apparatus according to claim 21, wherein said insulative layer comprises a polyester resin.

27. An apparatus according to claim 21, wherein the effective exposing area of the corona discharge of means (c) defines a slit exposing area of said pattern of image light exposed to said photoconductive layer.

28. An apparatus for forming an electrophotographic image comprising:

a. a photosensitive plate having a conductive base, a photoconductive layer overlying said base and exhibiting p-type or n-type semiconductivity and an insulative layer overlying said photoconductive layer, said photosensitive plate being characterized in having carrier charge of a polarity corresponding to the conductivity type of said photoconductive layer injectable from said conductive base into said photoconductive layer and bound in the region of the interface between said insulative and photoconductive layers;

b. charging means for applying a first charge of a polarity opposite to the conductivity type of said photoconductive layer substantially uniformly onto said insulative layer to inject and bind carrier charge in the region of the interface between said insulative and photoconductive layers;

c. means for exposing said photoconductive layer to a pattern of image light while applying a corona discharge of a polarity opposite to that of said first charge onto said insulative layer;

d. means for exposing said photoconductive layer with activating light to discharge bound carrier charge remaining in the region of said interface and form a high contrast electrostatic image;

e. developing means for visualizing said electrostatic image;

f. means for transferring said visualized image onto a copy sheet; and g. cleaning means for removing from said photosensitive plate residual developer remaining after the transfer of the visualized image whereby said photosensitive plate is prepared for repeated use.

29. An apparatus according to claim 28, wherein said insulative layer is transparent to both said image and activating light, and wherein means (c) and (d) include means for exposing said photoconductive layer through said transparent insulative layer.

30. An apparatus according to claim 28, wherein said means for transferring said visualized image comprises means for physically pressing said copy sheet against said insulative layer in the absence of an external electric field.

31. An apparatus according to claim 28, wherein the thickness of said insulative layer is between 10 and 50$\mu$.

32. An apparatus according to claim 28, further comprising means for subjecting said photosensitive plate to a corona discharge immediately before cleaning.

33. An apparatus as in claim 28, wherein said cleaning means includes means for establishing a charge relative to said photosensitive plate to facilitate the removal of residual developer.

* * * * *

UNITED STATES PATENT AND TRADEMARK OFFICE

CERTIFICATE OF CORRECTION

PATENT NO. : 4,071,361

DATED : January 31, 1978

INVENTOR(S) : GIICHI MARUSHIMA

It is certified that error appears in the above-identified patent and that said Letters Patent are hereby corrected as shown below:

In the drawings:

Sheet 2, FIG. 5-1, 2a2, in the DARK area, delete the plus (+) sign in base 1, add a plus (+) sign in base 1 directly beneath the minus (-) sign in photoconductive layer 2, and add a plus (+) sign in photoconductive layer 2 adjacent the plus (+) sign and directly beneath the minus (-) sign above the insulating layer 3.

Sheet 2, FIG. 5-1, 2b1, in the DARK area, change the minus (-) sign above the insulating layer 3 to a plus (+) sign and delete the center (middle) plus (+) sign in the base 1.

Sheet 2, FIG. 5-1, 2c2, in the DARK area, delete the plus (+) sign which is fourth from the right in base 1.

In the title page:

Delete the following from the Foreign Priority Application Data:

"Feb. 23, 1966 Japan .....41-10915
Dec. 1, 1965 Japan .....40-73379
Oct. 28, 1965 Japan .....40-65784
Dec. 24, 1965 Japan .....40-79869
Jan. 9, 1965 Japan .....40-53471"

UNITED STATES PATENT AND TRADEMARK OFFICE

CERTIFICATE OF CORRECTION

PATENT NO. : 4,071,361

DATED : January 31, 1978

INVENTOR(S) : GIICHI MARUSHIMA

It is certified that error appears in the above–identified patent and that said Letters Patent are hereby corrected as shown below:

In the title page:

After "Assignee:" insert -- [+] Notice - The term of this patent subsequent to April 15, 1986 has been disclaimed.--

In the specification:

Column 11, line 33, "change" should read --charge--;
Column 11, line 34, "charge" (first occurrence) should read --change--.

Signed and Sealed this

*First* Day of *May 1979*

[SEAL]

*Attest:*

RUTH C. MASON
*Attesting Officer*

DONALD W. BANNER
*Commissioner of Patents and Trademarks*